US006076229A

United States Patent [19]

Berglund

[11] Patent Number: 6,076,229

[45] **Date of Patent: *Jun. 20, 2000**

[54] AQUEOUS CLEANING SOLUTIONS INCORPORATING OZONE-RESISTANT SURFACTANTS WITH LOW FOAM CHARACTERISTICS

[75] Inventor: Edward D. Berglund, Maplewood, Minn.

[73] Assignee: CFR Corporation, New Brighton, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/999,647

[22] Filed: Nov. 25, 1997

Related U.S. Application Data

[63] Continuation of application No. 08/659,353, Jun. 6, 1996, Pat. No. 5,839,155.

[51] Int. Cl.[7] ..... A47L 7/00; C11D 3/00; C11D 17/08

[52] U.S. Cl. ..... 15/321; 15/320; 510/405; 510/426; 510/302; 510/303; 510/317

[58] Field of Search ..... 510/426, 405, 510/302, 303, 317; 15/320, 321, 339

[56] References Cited

U.S. PATENT DOCUMENTS

| | | | |
|---|---|---|---|
| 3,607,760 | 9/1971 | McIntyre | 252/104 |
| 4,490,270 | 12/1984 | Hackett et al. | 252/106 |
| 5,125,126 | 6/1992 | Bonnant | 15/321 |
| 5,252,243 | 10/1993 | Minns et al. | 252/102 |
| 5,284,597 | 2/1994 | Rees | 252/103 |
| 5,338,475 | 8/1994 | Corey et al. | 252/102 |
| 5,348,556 | 9/1994 | Minns et al. | 8/137 |
| 5,389,278 | 2/1995 | Minnes et al. | 252/102 |
| 5,432,975 | 7/1995 | Hilmanowski | 15/320 |
| 5,484,549 | 1/1996 | Hei et al. | 252/103 |
| 5,492,540 | 2/1996 | Leifheit et al. | 8/111 |
| 5,522,580 | 6/1996 | Varner, Jr. et al. | 252/102 |
| 5,567,444 | 10/1996 | Hei et al. | 424/616 |
| 5,763,382 | 6/1998 | Cooper et al. | 510/303 |

*Primary Examiner*—Necholus Ogden
*Attorney, Agent, or Firm*—Larkin, Hoffman, Daly & Lindgren, Ltd.; Frederick W. Niebur

[57] ABSTRACT

An aqueous surface cleaning composition consists essentially of water and a surfactant. The surfactant is incorporated, preferably, at a concentration of 10–100 parts per million, by weight as a proportion of the entire composition, and more preferably is within the range of about 70–93 ppm. The preferred surfactant is sodium octyl sulfate, which is resistant to combining or interacting with ozone and has the desired foaming characteristics. Other ozone resistant surfactants may be employed, alone or in combination with one another. The liquid cleaning composition is used advantageously in a fluid cycling cleaning system or a recycling system in which the liquid is provided from a canister to a cleaning tool head, then returned over a vacuum conduit to the canister for filtration and reuse. Circulation of the cleaning composition through the system agitates the composition, enabling the surfactant to promote formation of a foam layer that covers an otherwise exposed surface of the cleaning composition, virtually preventing the outgasing of ozone. The cleaning composition can be enhanced through water conditioners, alkalinity enhancers and other additives with little or no ozone demand. The cleaning composition is conveniently prepared by making a liquid concentrate incorporating the surfactant at 0.9–1.2 percent, then diluting the concentrate with water. Surfaces are cleaned by incorporating ozone into the liquid cleaning composition, delivering the ozone-containing composition to an application area, and using a vacuum to draw the cleaning composition, air, and removed soil away from the application area.

13 Claims, 1 Drawing Sheet

AQUEOUS CLEANING SOLUTIONS INCORPORATING OZONE-RESISTANT SURFACTANTS WITH LOW FOAM CHARACTERISTICS

This is a continuation of parent application Ser. No. 08/659,353 filed Jun. 6, 1996 now U.S. Pat. No. 5,839,155.

BACKGROUND

This invention concerns surface cleaning systems, and more particularly concerns the liquid cleaning solutions cycled within such systems, especially systems of the continuous flow recycling type.

Continuous flow recycling has gained widespread acceptance as an effective technique for cleaning carpets, upholstery, fabric, wall coverings and hard surfaces. Such systems spray a liquid cleaning solution toward a surface being cleaned. Simultaneously, a vacuum source creates a high velocity air stream that draws the atomized liquid toward the surface, and into the material beneath the surface in the case of porous material. Almost immediately, the air stream is diverted to draw the liquid upwardly away from the surface, along with soil and other contaminants extracted from the surface and/or from porous material beneath the surface. This enables the recovery of most of the cleaning solution, for filtration and recycling to extract further foreign matter from the surface being cleaned.

Continuous flow recycling systems typically include a tank or canister containing liquid cleaning solution, a motor and a pump for circulating the cleaning solution, a cleaning tool head for direct spray application of the liquid to a surface being cleaned, and a vacuum motor and blower for recovering the liquid solution and returning it from the cleaning tool head to the tank. These components may be separate and connected through tubing or hosing, or disposed within the housing of a self-contained unit to which a cleaning tool head is mounted directly, as shown in U.S. Pat. No. 5,432,975 (Hilmanowski).

Continuous flow recycling systems, and other systems that cycle liquid solution (e.g., from a supply tank to a separate tank for receiving spent liquid), have been found effective in suspending and removing soil. There are certain contaminants, however, that are difficult to control with ordinary aqueous cleaning solutions. For example, carpets and upholstery fabric, particularly in warm and humid environments, provide breeding grounds for microorganisms. This problem is a particular concern in hospitals, clinics and other treatment and diagnostic facilities. In these cases, the conventional cleaning solutions can be augmented with additives such as quaternary ammonium compounds, chlorine, or acidic sanitizers. Each of these additives has disadvantages. The quaternary compounds have only a limited effect on gram-positive bacteria and tend to leave a residue that attracts soil to the surface just cleaned. Chlorine compounds are not effective in high soil load conditions, are corrosive to metals and certain other materials, can bleach dyes, and can degrade natural fibers such as wool and cotton. Finally, acidic sanitizers are not particularly effective against yeasts and molds, and have a residual acidity that may promote the growth of certain yeasts and molds. Further, all of these additives are potential pollutants that raise problems of waste disposal.

Use of these additives in continuous flow recycling systems raises a further problem of accumulation of the microbiological organisms and other contaminants that are not effectively reduced in concentration or eliminated by the additive being used. This particular problem can be avoided by using a system that does not recycle the liquid cleaning solution. However, systems that do not recycle the solution require frequent replenishment of the cleaning solution and waste disposal of the recovered solution.

Liquid cleaning solutions incorporating surfactants are known. For example, U.S. Pat. No. 5,338,475 (Corey, et al.) discloses a carpet cleaning composition including hydrogen peroxide and a nonionic, anionic or amphoteric surfactant from about 0.05–5.0%, by weight, advising the selection of a surfactant that, when employed in the recommended concentrations, does not leave a tacky or oily residue.

U.S. Pat. No. 4,490,270 (Hackett, et al.) is directed to a sanitizing liquid shampoo for carpets, including 0.1–20% surfactant, by weight. Suggested surfactants include sodium lauryl sulfate and sodium lauryl ether sulfate. U.S. Pat. No. 5,284,597 (Rees) teaches stable aqueous soft surface cleaning compositions containing a peroxygen reagent and an anionic surfactant such as sodium lauryl sulfate which can concentrate 0.4 to 0.6 percent of a base composition.

U.S. Pat. No. 5,492,540 (Leifheit, et al.) discloses a soft surface cleaning composition including from about 0.2% to about 6.0% of a surfactant, by weight. Leifheit teaches using surfactants for which the final composition dries to a non-tacky or non-sticky residue, to reduce the likelihood of resoiling fibers after their initial cleaning.

U.S. patent application Ser. No. 08/659,393 (Berglund), entitled Continuous Flow Cleaning System With Ozone Injection and filed Jun. 6, 1996 (incorporated herein by reference), discloses the incorporation of an ozone generator within continuous flow recycling systems and other systems that cycle liquid cleaning solutions. The incorporation of ozone ($O_3$) into the liquid cleaning solution provides several advantages:

1. The liquid cleaning solution is effective against contaminants resistant to ordinary cleaning solutions, yet avoids formation of unwanted residues, waste disposal problems and corrosion or other damage to materials being cleaned;
2. Ozone can be introduced into the cleaning liquid solution in a manner that enhances sanitizing effectiveness of the solution and tends to sanitize and deodorize the air near where the cleaning solution is contained and applied; and
3. The cleaning solution more effectively degrades organic soils and sanitizes treated surfaces, and more effectively maintains the fluid cycling equipment in a cleaner, more sanitized condition.

Preferably, ozone is introduced into the liquid cleaning solution in a gaseous state. Some of the ozone is dissolved, while some of the ozone remains in the gaseous state. In either case, the ozone is a powerful oxidizing agent and an effective biocide at low concentrations, e.g., in the range of about 0.01 to about 4 ppm (parts per million). Ozone is more water soluble than oxygen, so that it readily combines with any water-based cleaning solution. Concentrations in air or water diminish due to the transient nature of ozone (approximately a 20-minute half-life). Consequently, ozone leaves no residue to attract contaminants to surfaces just cleaned. The decomposition of ozone produces oxygen, avoiding any concerns of toxicity, pollution or waste disposal. At low concentration levels, ozone is non-corrosive and does not discolor or otherwise degrade carpeting or fabric.

The presence of ozone is beneficial throughout the cleaning system, not just at the cleaning tool head. In the solution recovery segment, ozone continues to work on soils which have been extracted from the surface, and tends to sanitize and maintain the cleanliness of the hosing forming the recovery segment.

Ozone dissolved within the cleaning solution in the tank continues to work on soils returned to the tank from the application area. Some of the ozone escapes from the cleaning solution in the tank and interacts with air in the cavity above the cleaning solution. This combines with undissolved gaseous ozone returned to the cavity via the recovery segment, to provide cleaner and more sanitized air within the tank.

Thus, the escape of ozone from the cleaning solution, sometimes referred to as "outgasing," has a known beneficial effect.

At the same time, the outgasing of ozone has several undesirable consequences. One of these is that outgasing reduces the concentration of dissolved ozone within the liquid cleaning solution. The reduction of ozone concentration within the cleaning solution eventually reduces the effectiveness of the cleaning solution. Ozone concentrations are further reduced by cleaning solution additives that have a high affinity for oxidation, or otherwise promote decomposition of ozone.

Another unwanted consequence of outgasing is that it can increase the amount of ozone released to the atmosphere around the system, primarily through an air exhaust of the tank or canister. As disclosed in the aforementioned application, Ser. No. 08/659,393, a bed of activated carbon, that catalytically converts excess ozone into oxygen, can be provided at the canister exhaust to reduce the concentration of ozone at the exhaust ports.

The above notwithstanding, it is preferred to reduce the decomposition and outgasing of ozone as much as possible, both to maintain the effectiveness of the liquid cleaning solution and to minimize the ozone released by the system into the surrounding atmosphere.

Accordingly, it is an object of the present invention to provide a liquid cleaning solution incorporating constituents that inhibit ozone decomposition.

Another object is to provide a liquid cleaning solution in which the tendency of ozone outgasing is reduced.

A further object is to provide a fluid cycling cleaning system in which a liquid surface cleaning composition contained within and circulated throughout the system includes constituents resistant to interacting or combining with ozone.

Yet another object is to provide a process for cleaning a surface with a liquid cleaning solution that incorporates ozone and components resistant to combining or interacting with ozone.

SUMMARY OF THE INVENTION

To achieve this object and others, there is provided a liquid cleaning solution consisting essentially of water and a surfactant at a concentration, by weight as compared to the weight of the cleaning solution, of less than about 200 ppm. Preferably, the surfactant concentration ranges from about 10 to about 100 ppm. More preferably, the surfactant concentration is about 70–93 ppm.

The preferred surfactant (surface-active agent) is sodium octyl sulfate.

Other suitable surfactants include sodium octyl sulfonate, sodium lauryl sulfate, sodium ethyl hexyl sulfate, sodium lauryl ether sulfate, sodium alkylated (mono and didecyl) diphenyl oxide disulfonates, sodium alkylated (mono and didodecyl) diphenyl oxide disulfonates, and certain ethylene oxide, propylene oxide block copolymers having low HLB (Hydrophile Lipophile Balance) values and low foam characteristics.

These surfactants, when incorporated into the aqueous cleaning composition in the recommended concentrations, are particularly effective in maintaining concentrations of ozone in the cleaning compositions, e.g., in the range of 0.1–4 ppm where the ozone has been found to be an effective biocide, or a narrower range of 0.05–0.5 ppm for optimum cleaning and microbiological control. The surfactants reduce the surface tension of the liquid cleaning composition. Consequently, agitation of the cleaning solution leads to formation of a layer or cap of foam over otherwise exposed surface areas. This considerably reduces the loss of ozone due to outgasing. Secondly, the surfactants have a high resistance to combining or interacting with ozone. In particular, they are not easily oxidized by ozone, which leads to more stable levels of the surfactant and the ozone within the cleaning composition.

These features are particularly useful in cleaning systems that employ continuous flow recycling, where a single canister is used to provide the cleaning composition to the surface and to retrieve already applied liquid for reuse after filtration within the canister. The liquid cleaning composition within the canister forms a relatively large upper surface which, if exposed, would facilitate outgasing.

The above noted surfactants, however, form a layer or cap as a barrier against outgasing, and because of their resistance to ozone oxidation, further tend to maintain effective ozone concentrations. Sodium octyl sulfate is a particularly preferred surfactant, because of its high resistance to combining with ozone and its lower foam characteristics.

A salient feature of the present invention is that the surfactants can be incorporated at concentrations considerably lower than concentrations previously taught with respect to the incorporation of surfactants for their cleaning and emulsifying characteristics. In particular, weight concentrations as low as 10 parts per million (surfactant as compared to the complete composition) have been found effective in maintaining satisfactory ozone concentrations. It is to be understood that the term "maintaining" in this context is not intended to imply an absolute prevention of ozone escape from the cleaning composition. Rather, the resistance to combining with ozone in combination with favorable foaming tendencies considerably reduce the outgasing of ozone, to maintain the ozone at effective cleaning and sanitizing levels for durations previously not possible, despite the need for some ozone replenishment.

The liquid cleaning solution can incorporate further constituents that promote maintenance of desired ozone concentrations. For example, sodium carbonate and sodium bicarbonate provide desired alkalinity and build detergency while inhibiting hydroxide ion initiated decomposition of ozone. They also are radical scavengers that inhibit the free radical decomposition of ozone.

Certain water conditioners such as citric acid neutralized to sodium citrate, tetrapotassium pyrophosphate and sodium hexametaphosphate, are conditioners that do not have an ozone demand.

As noted in the aforementioned '393 application, the ozone can be injected into the cleaning solution at a variety of points along its path of circulation, although most preferably it is injected along a separate conduit with an intake for receiving liquid from the canister and an exit for providing the ozone-injected liquid back to the canister.

Another aspect of the present invention is a process for cleaning a surface, including the following steps:

(a) providing a liquid surface cleaning composition consisting essentially of water and a surfactant at a concentration from about 10 ppm to about 200 ppm, by weight, wherein the surfactant is resistant to interacting or combining with ozone;

(b) incorporating ozone into the liquid cleaning composition;

(c) delivering the ozone-containing cleaning composition to an application area of a surface to be cleaned; and (d) providing a vacuum to draw the cleaning compsition, air and removed soil away from the application area.

The preferred manner of providing the liquid surface cleaning composition is to prepare a liquid concentrate incorporating the surfactant at about 0.9 percent to about 1.2 percent by weight, diluting the concentrate with water at least until the concentration of the surfactant is at most about 200 ppm.

Thus, in accordance with the present invention, an aqueous surface cleaning compositions incorporate ozone and surfactants and other constituents resistant to combining or interacting with ozone. The surfactants help maintain effective ozone concentrations due to their resistance to oxidation and reduction of surface tension to enhance foam formation when the cleaning composition is agitated during its circulation. Because the surfactants are effective at extremely low concentrations, certain problems associated with surfactants, such as tacky or oily residues that can accelerate carpet resoiling, are reduced or eliminated. While especially useful to enhance continuous flow recycling cleaning systems, the cleaning compositions can enhance the effectiveness of most any type of cleaning system that utilizes a liquid cleaning solution.

IN THE DRAWINGS

For a further understanding of the above and other features and advantages, reference is made to the following detailed description and to the drawings, in which:

FIG. 1 is a schematic view of a continuous flow recycling system using a liquid cleaning composition according to the present invention; and FIG. 2 is a schematic view of a canister of the system used to hold, supply and retrieve the liquid cleaning composition.

DETAILED DESCRIPTION OF THE PREFERRED EMBODIMENTS

Figure 1:
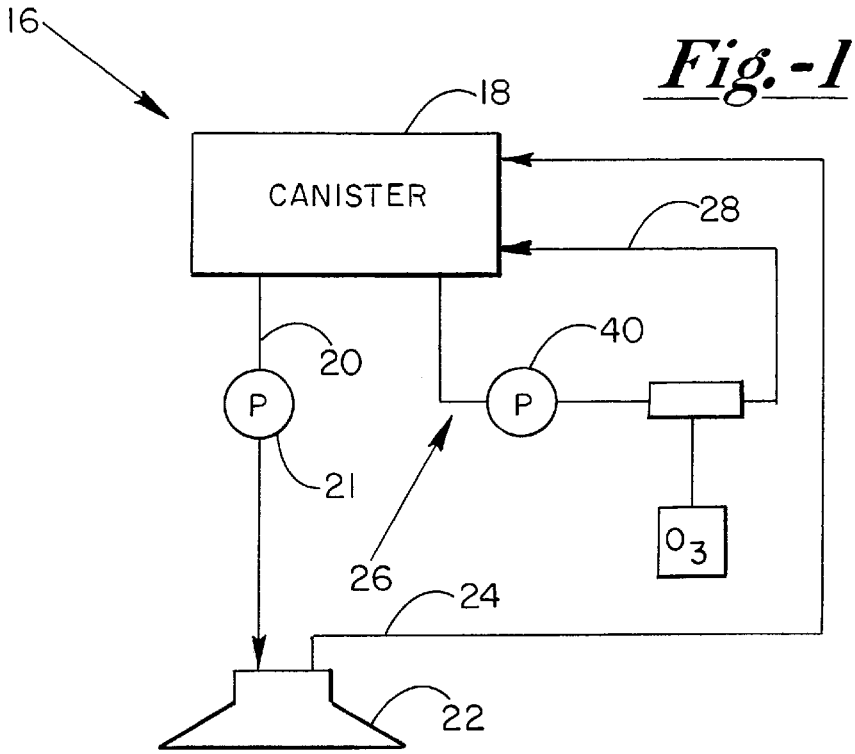

Turning now to the drawings, there is shown in FIG. 1 a vacuum-operated continuous flow recycling surface cleaning device 16 used primarily to clean soft surfaces such as carpeted flooring and upholstered furniture, although it can be used on hard surfaces as well. The device includes a canister 18 that provides a reservoir for a liquid cleaning solution or composition. A supply conduit or tubing 20 and a fluid pump 21 move the cleaning composition from the canister to an applicator or cleaning tool head 22, where the cleaning solution, atomized and augmented by an air stream, is sprayed onto the surface being cleaned. A vacuum conduit or hose 24 is used to recover cleaning solution from the surface, and return the cleaning solution and air to canister 18. For a more detailed explanation of the cleaning device, reference is made to the aforementioned '393 patent application.

An injection system 26 is mounted to canister 18 for introducing ozone into the liquid cleaning solution. The injection system includes a conduit 28 used solely for ozone injection, although ozone can be injected into the cleaning solution at a variety of locations as it is circulated throughout device 16.

Figure 2:
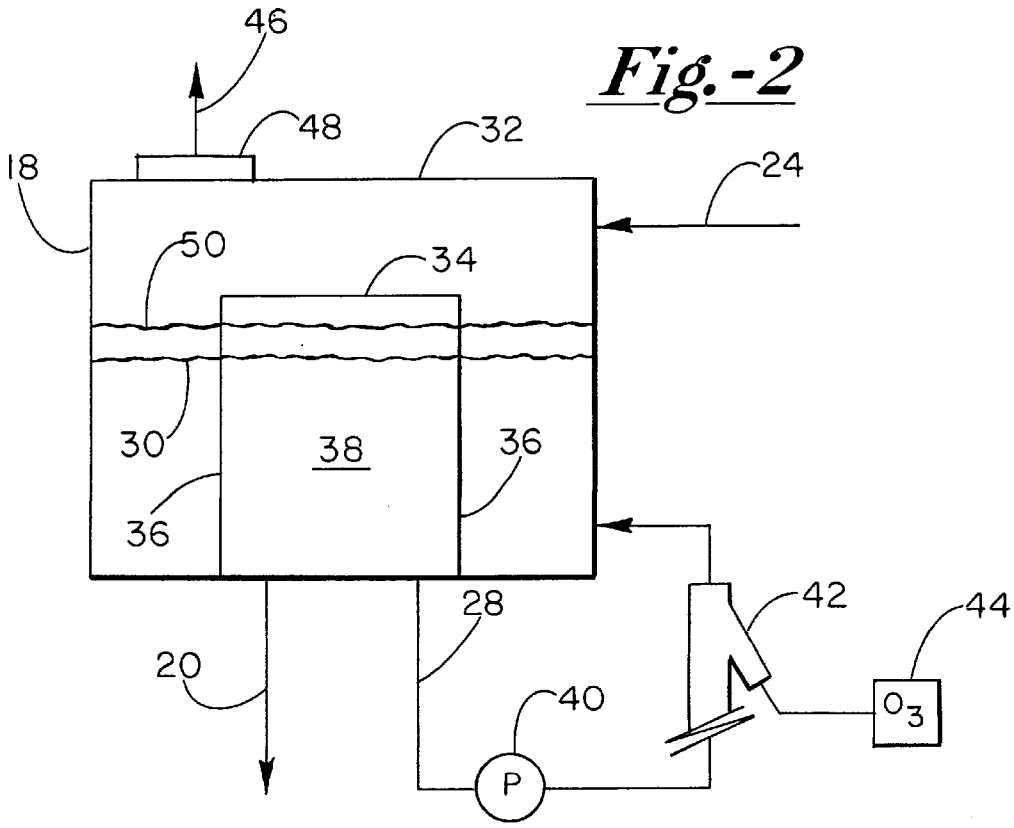

The cleaning device also includes a system for filtering the liquid cleaning solution. As seen in FIG. 2, canister 18 contains the cleaning solution to an upper surface level 30 selected to provide an ample upper air cavity 32. A filter 34, including a cylindrical filter wall 36, is substantially submerged. The filter wall is a mesh that allows the cleaning solution to pass, while preventing entry of soil and other particulate matter from outside of the filter to its interior. Accordingly, cleaning solution within a chamber 38 of the filter is virtually free of particulates exceeding a size commensurate with the selected mesh.

Supply conduit 20 is open to the canister interior within chamber 38, to ensure that filtered cleaning solution is supplied to the cleaning tool head. Vacuum conduit 24 is open to the canister outside of filter 34, directly to the air cavity above the cleaning solution.

Ozone-injection conduit 28 is in fluid communication with canister 18 at a conduit inlet inside of chamber 38. An outlet of conduit 28 is open to the canister interior, outside of the filter. Mounted along conduit 28 are a fluid pump 40 and an ozone injector 42 downstream of the fluid pump. An ozone generator 44 is fluid coupled to the ozone injector, whereby ozone is injected into the cleaning liquid as it circulates through conduit 28.

Ozone is highly water soluble, more so than oxygen. Consequently, much of the ozone is dissolved into the water-based liquid cleaning composition, both within injector 42 and along conduit 28 toward canister 18, where the ozone-injected cleaning solution is provided to the reservoir, below upper surface 30.

Ozone is an effective biocide at concentrations as low as 0.01 ppm (parts per million). For optimum cleaning and microbiological control, concentrations should range from about 0.05 ppm to about 0.5 ppm. The injection system preferably operates continuously, initially to introduce ozone and increase its concentration in the cleaning solution, and then to maintain the ozone concentration at a desired level. Alternatively, the system can be operated continuously at first, then intermittently to replenish the ozone and thus maintain its concentration within a desired range.

Ozone dissolved within the cleaning solution provides benefits throughout the pathway over which the cleaning solution circulates, which can encompass supply conduit 20, vacuum conduit 24, ozone introduction conduit 28, and the interior of canister 18, along with any further fluid path segments, e.g., a primer conduit or a counterflow conduit. When introduced into the canister, the treated cleaning solution begins to work on soils in the liquid within the canister and on interior surfaces of the canister. As it proceeds through filter 34. The cleaning solution tends to clean and sanitize the filter. Likewise, the ozone-injected cleaning composition tends to clean and sanitize supply conduit 20 and the cleaning tool head.

When sprayed onto a surface, the treated liquid cleaning composition sanitizes and deodorizes carpeting or upholstery, as well as freeing embedded soils. Finally, as it returns to canister 18 as part of a stream that also includes air and extracted soils, the treated solution continues to work on the soils, along with the interior surfaces of the cleaning tool head and vacuum conduit.

Some of the ozone is not dissolved, but rather remains in its gaseous state and rises to air cavity 32 when introduced into the canister. While in the cavity, the gaseous ozone acts as a scrubber, deodorizing and sanitizing air within the cavity, and within an exhaust system 46 for releasing air from the air cavity. It has been found that ozone effectively performs this function over a wide range of concentrations, e.g., from about 0.01 ppm to about 4 ppm.

Present EPA (Environmental Protection Agency) regulations set a standard of 0.10 ppm for the concentration of ozone in ambient air. Generally, air leaving the exhaust system is rapidly dispersed so that the ozone concentration remains well below this standard. However, to ensure that ozone concentrations remain well within the safe levels even in confined spaces, exhaust system 46 can include a bed 48 of activated carbon that catalytically converts excess ozone into oxygen. This keeps the concentration of ozone in the exhausted air to much less than 0.1 ppm.

Ozone provides the aforementioned benefits throughout the system, regardless of whether it is dissolved into the cleaning composition or remains in a gaseous state. While the proportion of ozone dissolved to that remaining gaseous is not critical, the primary benefit is derived from maintaining an appropriate ozone concentration in the liquid cleaning composition, and secondly an appropriate concentration within the air cavity.

The ozone concentration in the cleaning solution is influenced by the tendency of dissolved ozone to escape from the liquid into the air. This phenomenon, known as "outgasing," occurs primarily within canister 18, due to the amount of cleaning solution inside the canister, the relatively large area of upper surface 30, and the partial vacuum maintained in air cavity 32. In general, it is advantageous to minimize the outgasing tendency, to maintain a higher concentration of ozone in the cleaning solution. This is desirable for maintaining efficacy of the cleaning composition, and for maintaining a low concentration of ozone gas in cavity 32, thus to ensure that air leaving the canister through exhaust system 46 has an acceptably low ozone concentration.

To this end, a surfactant (surface-active agent) is incorporated into the cleaning solution at a low concentration. When dissolved in the cleaning solution, the surfactant reduces the surface tension of the liquid. Consequently, normal agitation of the cleaning solution as it is circulated throughout the fluid pathway forms a layer or cap of foam 50 over the liquid at surface level 30. Foam cap 50 can vary in thickness from about one-eighth of an inch to more than about three inches. The foam cap acts as a barrier to considerably reduce the loss of ozone to outgasing.

Suitable surfactants not only reduce surface tension, but also are resistant to combining or interacting with ozone, in particular resistant to ozone oxidation. This facilitates formation of the foam cap without using up or destroying dissolved ozone. The presently preferred surfactant is sodium octyl sulfate, which has been found effective when incorporated into the cleaning composition in concentrations of about 10 to about 100 parts per million,and also in concentrations of about 10 to about 30 parts per million. Examples of other suitable surfactants include sodium octyl sulfonate, sodium lauryl sulfate, sodium ethyl hexyl sulfate, sodium lauryl ether sulfate, sodium alkylated (mono and didecyl) diphenyl oxide disulfonates, sodium alkylated (mono and didodecyl) diphenyl oxide disulfonates, and certain ethylene oxide, propylene oxide block copolymers having low HLB values and low foam characteristics. More particularly, copolymers with HLB values in the range of about 3–7, as compared to such copolymers having HLC values in the range of 12–15 commonly used in standard cleaning compositions, have a higher proportion of propylene and are more ozone stable. The preferred concentration varies with the particular surfactant selected, but in general is less than about 200 ppm.

Sodium octyl sulfate is available, for example, from DeForest Enterprises Inc. under the brand name Desulf SO LF33. Sodium ethyl hexyl sulfate is available from Witco under the brand name Witcolate D510. The ethylene oxide, propylene oxide block copolymer is available from BASF under the name Pluronic L62LF. Sodium mono and didecyl disulfonated diphenyl oxide is available from Dow Chemical under the name Dowfax 3B2.

A substantial advantage of the present invention arises from the surprising effectiveness of the surfactants when incorporated at the aforementioned concentrations, which are orders of magnitude less than typical concentrations and ranges noted above in connection with references that teach using surfactants for their cleaning and emulsifying properties. This minimizes or virtually eliminates certain problems associated with surfactants provided in larger concentrations, such as sticky or oily residues that attract soils and increase the likelihood of carpets or other materials becoming soiled more quickly after they have been cleaned. Thus, the combination of ozone and a surfactant at the concentrations taught herein effectively sanitizes surfaces without introducing a tendency to resoil more rapidly.

By reducing outgasing, foam cap 50 provides for improved retention of dissolved ozone in the cleaning solution, increasing the benefits derived from the dissolved ozone as the liquid circulates throughout the system. These benefits are further increased because of the low ozone demand of the chosen surfactants. Further, the choice of surfactant and its concentration can be employed to control or tailor the foam cap, especially as to its thickness, thereby controlling the concentration of ozone to meet particular needs.

The favorable characteristics of the cleaning composition can be enhanced by additives that exhibit low ozone demand. For example, additives to enhance alkalinity of the composition or to build detergency further can be selected for their tendency to preserve ozone within the composition. Specifically, sodium carbonate, sodium bicarbonate and sodium sesqui carbonate enhance alkalinity and detergency, and also are free radical scavengers that inhibit the free radical decomposition of ozone. They also inhibit hydroxide ion initiated decomposition of ozone.

Another preferred additive is a water conditioner. Citric acid neutralized to sodium citrate, tetrapotassium pyrophosphate, and sodium hexametaphosphate are suitable conditioners because they lack an ozone demand.

The following are examples of liquid cleaning compositions prepared according to the present invention.

EXAMPLE I

First, a concentrate is prepared with the following constituents at the percentages indicated:

| | |
|---|---|
| Sodium octyl sulfate | 0.9% |
| Ethylene oxide, propylene oxide block copolymer | 0.3% |
| Sodium sesqui carbonate | 7.0% |
| Sodium carbonate | 2.2% |
| Citric acid | 0.8% |
| Water | 86.3% |

The concentrate is diluted substantially, in a proportion of approximately one ounce per gallon, so that the sodium octyl sulfate is diluted to about 70 ppm and the ethylene oxide, propylene oxide block copolymer is diluted to about 23 ppm in proportion to the cleaning composition as used.

EXAMPLE II

A concentrate, again intended for dilution at approximately one ounce of concentrate per gallon of water, includes the following constituents:

| | |
|---|---|
| Sodium ethyl hexyl sulfate | 0.6% |
| Ethylene oxide, propylene oxide block copolymer | 0.6% |
| Sodium sesqui carbonate | 5.0% |
| Sodium carbonate | 5.0% |
| Tetrapotassium pyrophosphate | 2.2% |
| Water | 86.6% |

EXAMPLE III

Once again, a concentrate, intended for one ounce per gallon dilution as in the previous examples, incorporates the following constituents:

| | |
|---|---|
| Sodium mono and didecyl disulfonated diphenyl | 0.3% |
| Sodium octyl sulfate | 0.3% |
| Ethylene oxide, propylene oxide block copolymer | 0.3% |
| Sodium sesqui carbonate | 7.0% |
| Sodium carbonate | 2.0% |
| Citric acid | 0.8% |
| Sodium hexametaphosphate | 2.0% |
| Water | Balance |

It will be apparent to those skilled in the art that the invention can be practiced according to embodiments other than the foregoing examples, which are provided for illustration rather than limitation, with the invention to be defined in accordance with the following claims.

What is claimed is:

1. A fluid cycling cleaning system, including:

a reservoir, and an aqueous surface cleaning composition contained in the reservoir, said cleaning composition consisting essentially of water, and from about 10 ppm to about 200 ppm by weight of a surfactant component resistant to interacting with ozone and selected from the group consisting essentially of: low foaming anionic surfactants; and ethylene oxide, propylene oxide block copolymers having HLB values of at most 7:

a fluid dispensing conduit in fluid communication with the reservoir for conveying the cleaning composition from within the reservoir to an application area outside of the reservoir, and a fluid recovery conduit for recovering the cleaning composition from the application area; wherein the reservoir, the fluid dispensing conduit and the fluid recovery conduit cooperate to provide a fluid pathway for the cleaning composition;

an ozone source, fluid coupled to the fluid pathway, for introducing ozone into the cleaning composition, whereby at least some of the ozone is dissolved into the cleaning composition; and an applicator fluid-coupled to the dispensing conduit for applying the cleaning composition, with ozone dissolved therein, to the application area.

2. The system of claim 1 wherein:

said ozone source is adapted to introduce the ozone at a rate sufficient to maintain the ozone at a concentration within the range of about 0.01 ppm to about 4 ppm of the cleaning composition, by weight.

3. The system of claim 1 wherein:

said surfactant component consists essentially of at least one of the following constituents: sodium octyl sulfate; sodium octyl sulfonate; sodium ethyl hexyl sulfate; sodium mono and didecyl disulfonated diphenyl; sodium mono and didodecyl disulfonated diphenyl; and said ethylene oxide, propylene oxide block copolymers.

4. The system of claim 3 wherein:

said surfactant component consists essentially of sodium octyl sulfate from about 10 ppm to about 100 ppm, by weight.

5. The system of claim 4 wherein:

the surfactant includes ozone at a concentration in the range of about 0.05–0.5 ppm, by weight.

6. The system of claim 1 wherein:

said surfactant is incorporated at a concentration ranging from about 10 ppm to about 100 ppm, by weight.

7. The system of claim 6 wherein:

said concentration of the surfactant is in a range from about 10 ppm to about 30 ppm, by weight.

8. The system of claim 1 wherein:

the surfactant includes ozone at a concentration of about 0.01 ppm to about 4 ppm.

9. The system of claim 8 wherein:

the concentration of ozone is from about 0.05 ppm to about 0.05 ppm.

10. The system of claim 1 wherein:

the surfactant further includes an alkalinity enhancing constituent stable in the presence of ozone.

11. The system of claim 10 wherein:

the alkalinity enhancing constituent consists essentially of at least one of the following: sodium carbonate, sodium bicarbonate, and sodium sesqui carbonate.

12. The system of claim 1 wherein:

the surfactant further includes a water conditioner having substantially no ozone demand.

13. The system of claim 12 wherein:

said water conditioner consists essentially of at least one of the following: citric acid, tetrapotassium pyrophosphate, and sodium hexametaphosphate.

* * * * *